United States Patent [19]

Seragnoli

[11] 4,135,710

[45] Jan. 23, 1979

[54] APPARATUS FOR ADJUSTING THE SLOPE OF SIDE FLAPS OF STACKED CARDBOARD BLANKS

[75] Inventor: Enzo Seragnoli, Bologna, Italy

[73] Assignee: G. D. Societa per Azioni, Bologna, Italy

[21] Appl. No.: 785,581

[22] Filed: Apr. 7, 1977

[30] Foreign Application Priority Data

Apr. 12, 1976 [IT] Italy ..... 3397 A/76

[51] Int. Cl.[2] ..... B65H 1/06; B65H 3/08

[52] U.S. Cl. ..... 271/165; 214/8.50; 271/1; 271/12; 271/102

[58] Field of Search ..... 271/102, 99, 100, 101, 271/165, 166, 167, 169, 161, 104, 105, 1, 2, 11, 12, 13, 8 R, 20, 23; 214/8.5 D

[56] References Cited

U.S. PATENT DOCUMENTS

| | | | |
|---|---|---|---|
| 2,817,518 | 12/1957 | Anness | 271/23 |
| 3,383,105 | 5/1968 | Roberts | 271/23 |

FOREIGN PATENT DOCUMENTS

| | | | |
|---|---|---|---|
| 2436354 | 2/1976 | Fed. Rep. of Germany | 271/165 |

*Primary Examiner*—Bruce H. Stoner, Jr.
*Attorney, Agent, or Firm*—Kurt Kelman

[57] ABSTRACT

The device comprises at least one toothed roller supported by a rocking lever, and adapted to contact the outer edges of the side flaps of the blanks. Each toothed roller is mounted on a pin by a conventional free wheel device so as to exert a sliding friction on the outer edges of the flaps only during a downwardly directed movement thereof, thereby bending the flaps in a direction opposite to the one naturally assumed by them due to the composite conformation of the stack of blanks.

2 Claims, 5 Drawing Figures

APPARATUS FOR ADJUSTING THE SLOPE OF SIDE FLAPS OF STACKED CARDBOARD BLANKS

BACKGROUND OF THE INVENTION

The present invention relates to a device for adjusting the slope of side flaps, in particular of a stack of cardboard blanks to be individually fed in quick sequence to a packeting machine for packeting cigarettes into hinged-type packets.

DESCRIPTION OF THE PRIOR ART

As known, the cardboard blanks, or blanks in similar material, are fed to cigarette packeting machines by rhythmically withdrawing in quick sequence, usually by suction means, individual blanks from the bottom of a stack of blanks contained in a storage unit.

It is also known that the blanks, constituting the plane development of hinged-lid type cigarette packets, are substantially rectangular in shape and provided, along their longest sides, with flaps obtained by cutting the blanks both lengthwise, and substantially transversely.

The blanks are usually provided with one printed surface which is generally plasticized and substantially waterproof, while the other surface is rough and substantially porous.

The different nature of the two opposite surfaces, and in particular their different properties with respect to the changes of moisture and temperature conditions, are such as not to allow the blanks to keep a perfectly flat structure throughout the operating time.

In practice it has been observed that the blanks, stacked inside the magazine unit with their rough surfaces facing the suction means, assume a concave disposition with the concavity downwardly directed, while the side flaps are slightly upwardly bent.

The slope assumed by the side flaps can be such that, also due to small coplanar movements of a blank relative to the next superimposed one, the side flaps of one blank could engage the side flaps of the next blank, thus causing the simultaneous and undesiderable withdrawing by the suction means of more than one blank at time from the storage unit.

SUMMARY OF THE INVENTION

The object of the present invention is to provide a device for withdrawing in quick sequence individual blanks from the bottom of a stack of blanks contained in a magazine unit, by adjusting the slope of the side flaps thereof in such a manner so as to avoid that, at least during the withdrawing phase, the side flaps of one blank could interfere with the side flaps of the next superimposed one.

This and other objects are attained, according to the invention, by providing a device for adjusting the slope of side flaps, in particular of stacks of cardboard blanks to be individually, and in quick sequence, fed to hinged-lid type packeting machines, the blank pile being contained in a magazine unit, from the bottom of which said individual blanks are rhythmically removed by suction means, said device being characterized in that it comprises at least one bending element facing the side surface of the stack of blanks in vertical alignment with the side flaps of the stacks of blanks, and driving means for imparting to the bending element a cyclic motion in a contact relationship with the flaps, and in one direction corresponding to the advancing direction of the blanks towards the suction means, whereby to act with sliding friction on the flaps during at least the last part of the motion in the one direction, and along at least the bottom portion of side surface of the stack of blanks.

BRIEF DESCRIPTION OF THE DRAWINGS

Further objects and advantages of the invention will be better appreciated from a consideration of the following description, taken with the accompanying drawings, both description and drawings being given as a non restrictive example. In the drawings.

DESCRIPTION OF THE PREFERRED EMBODIMENT

Figure 2:
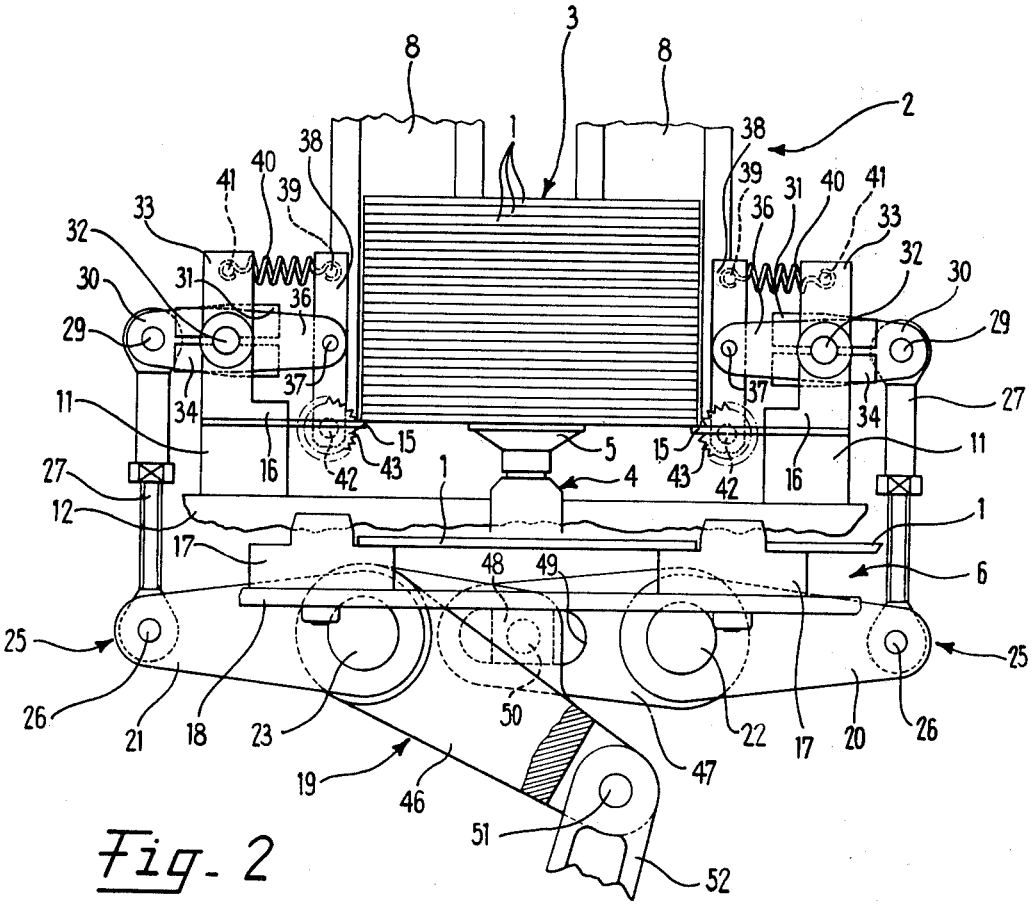
FIG. 2 is diagrammatic side elevation of a device according to the invention, some parts being shown in section, and other parts having been removed for clearness sake.

As particularly shown in FIG. 2, blanks 1 are disposed in a vertical hopper or magazine unit 2 to form a stack 3, each blank being the plane development of hinged-lid type cigarette packets (not shown).

Underneath the open bottom portion of the magazine unit 2 extractor means 4 comprising suckers 5 are reciprocatingly moved in a vertical direction for individually removing, in quick sequence, blanks 1 from the magazine unit 2, and for transferring individual blanks into a compartment of a stepwise advancing conveyor 6 for feeding them to a packeting machine (not shown).

Figure 3:
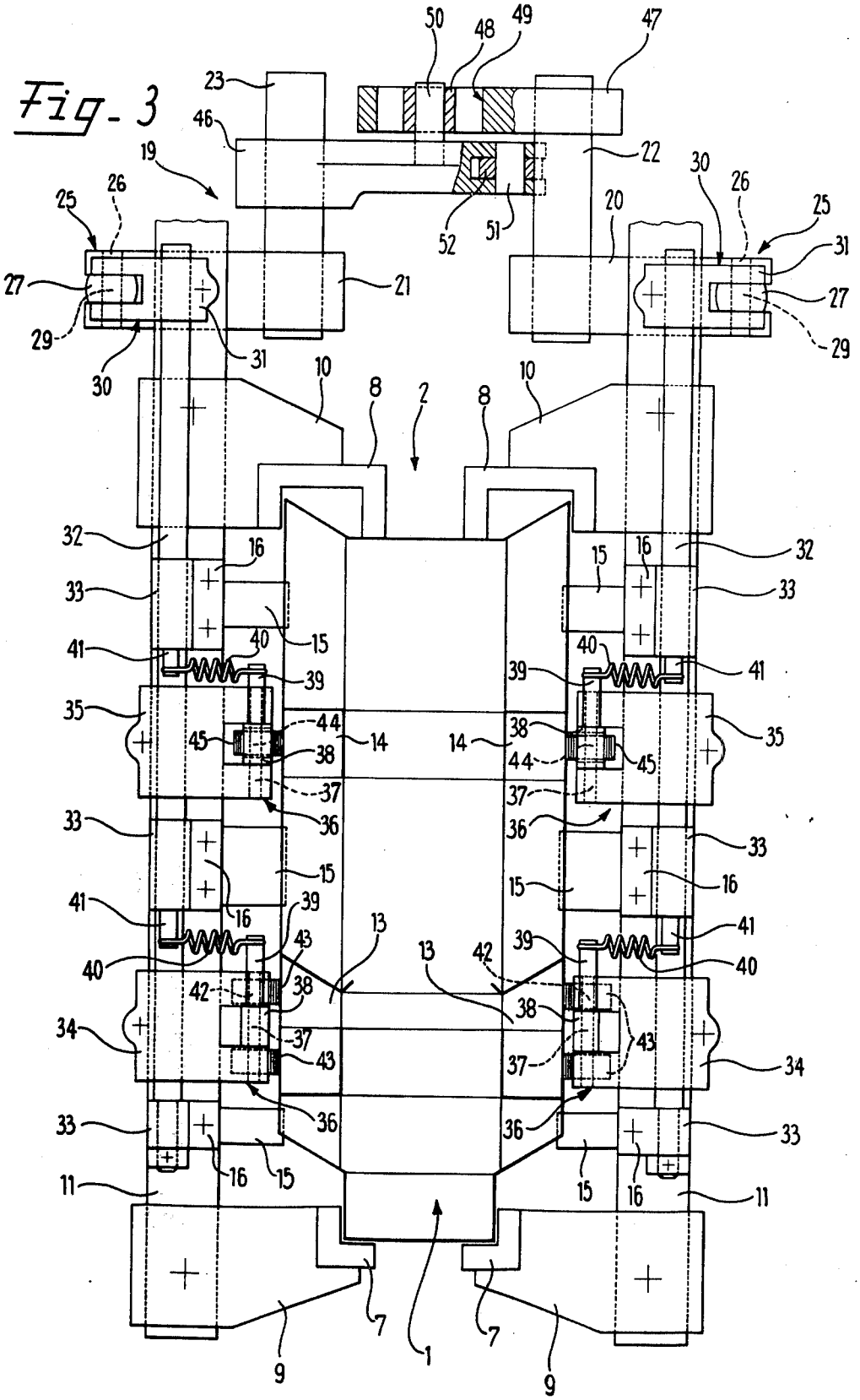
FIG. 3 is a diagrammatic plane view of the device shown in FIG. 2, some parts being shown in section, and other parts having been removed for clearness sake.

Magazine unit 2 can be filled from top either manually, or by means of an automatic filling apparatus of the type described, for example, in the Italian Pat. No. 992.092. The dimension of magazine unit 2 can be adjusted, in the plane of FIG. 3, along two orthogonal directions, and the same unit 2 substantially consists of two pairs of upwardly directed stanchions 7 and 8, secured to pairs of supporting block members 9 and 10. Block members 9 and 10 are longitudinally slidable along horizontal and parallel supporting rods 11, said rods 11 being connected in a transversely adjustable manner to a bed 12.

Figure 1:
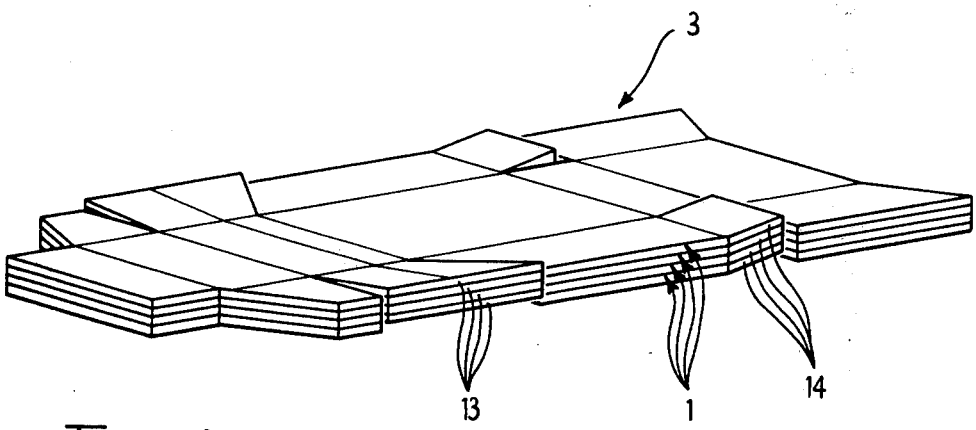
FIG. 1 is a perspective, diagrammatic top view of a blank pile to be fed to a packeting machine.

As shown in FIG. 1, the blanks 1 have a substantially rectangular shape, and each is provided — along its longitudinal edges — with two flaps 13 and 14 obtained by longitudinal, and substantially transversal cuttings. The flaps 13 are substantially transverse to blank 1, and flaps 14 are substantially longitudinal to same blanks.

Blanks 1, forming stack 3, are disposed inside the magazine unit 2 with their printed surface (not shown) upwardly directed, and with their longitudinal axis substantially parallel to rods 11. Stack 3 is supported, inside the magazine unit 2, by a plurality of strips 15 secured to block members 16 longitudinally slidable along, and adjustable on rods 11. The strips 15 are transversely positioned relative to supporting rods 11, and protrude for a short extent underneath the magazine unit 2 to form lateral supporting teeth for engaging the rough surface of the lowermost blank 1 of stack 3 along its longitudinal edges, and on positions thereof not making part of the flaps 13 and 14.

The removal of blanks 1 from magazine unit 2, as above stated, is carried out by the extractor means 4 which moves, firstly, upwardly to take the suckers 5 to contact the rough surface of the lowermost blank 1 of stack 3, and moves then downwardly thus causing an inflection of the blank, when the same overcomes the lateral teeth formed by the strips 15.

As soon as the blank has been withdrawn from the magazine unit 2, it is abandoned between a pair of transverse members 17 delimiting the above mentioned compartments of conveyor 6, transverse members 17 being secured to a plurality of belts 18 forming conveyor 6.

The conveyor 6 is stepwise moved by driving means (not shown) to which the extractor means 4 are also connected.

Mainly due to the different nature of their opposite surfaces, the blanks 1 are not compensated and they normally assume, as stated in the preamble of the present specification, a slightly cupola shaped configuration (not evidenced in the drawings) with the concavity donwardly directed, while the flaps 13 and 14 assume a disposition slightly upwardly directed, as shown in FIG. 1.

Should the descent, along the magazine unit 2, of blanks 1 be accompanied by slight movements of the blanks relative one to the other, it may happen that the flaps 13 and 14 of one blank 1 interfere with the flaps of the next superimposed blank, and the removal of the blank from the magazine unit 2 may cause also the removal of said next superimposed one.

In order to avoid the above mentioned drawback, according to the invention, the flaps 13 and 14 of blanks 1 are downwardly bent at least in the lower portion of stack 3, so as to avoid — during the removal phase — any possibility that the flaps 13 and 14 of a blank may hook the next superimposed blank.

The flaps 13 and 14 are downwardly bent by a bending device, generally indicated with the reference numeral 19, comprising two arms 20 and 21 perpendicular to rods 11, and keyed on shafts 22 and 23 parallel to rods 11, and rotatably supported on a bed 12.

The arms 20 and 21 extend outwardly, in opposite directions, from the relative shafts 22 and 23, and the end portion of each arm is provided with a fork shaped member 25 carrying a pin 26, parallel to shafts 22 and 23. The pin 26 rotatably engages an end lower bush of a link member 27 of adjustable length.

The two link members 27 extend upwardly and outside of rods 11, and the upper end of each link member 27 carries a bush through which rotatably extends a pin 29.

The opposite ends of pin 29 engage a fork shaped member 30 overlying the respective arm 20 and 21, and from which member 30 extends a pliers shaped member 31 clamping a shaft 32.

Shaft 32 extends above the related rod 11, sidewise relative to magazine unit 2, and also rotatably extends through a plurality of holes provided on the upper end of tailpieces 33, upwardly extending from block members 16.

Each shaft 32 further carries two pliers 34 and 35, each of which forms a fork member 36 extending in the direction of the magazine unit 2, and supporting a pin 37 on which a rocking lever 38 is pivoted.

The upper end of rocking lever 38 carries a pin 39 to which one end of a coil spring 40 is secured, the other end of spring 40 being secured to a pin 41 of the adjacent tail piece 33.

The rocking lever 38 of each pliers 34 extends vertically along one of the longitudinal side surface of stack 3, and carries in its lower end a pin 42 parallel to shafts 32. Each pin 42 carries two toothed rollers 43 brought in contact, by action of the related spring 40, with that portion of the longitudinal side surface of the stack 3 delimited by the outer lateral edges of the flaps 13 of blanks 1.

The rocking lever 38 of each pliers 35 also extends vertically along said longitudinal side surface of stack 3, and carries on its lower end a pin 44 (FIG. 3) parallel to pin 37. Each pliers 44 carries a toothed roller 45 brought in contact, by action of the related spring 40, with that portion of the longitudinal side surface of stack 3 delimited by the outer lateral edges of the flaps 14 of blanks 1.

Shafts 22 and 23 are interlinked by a toggle device comprising two levers 46 and 47 between them linked by a sliding block 48 slidingly mounted inside an axially disposed slot 49 machined on lever 47. A pin 50, extending parallel to shafts 22 and 23 and provided on lever 46, pivotally engages sliding block 48.

The free end of lever 46 is fork shaped and carries a pivot pin 51 of the big end of a connecting rod 52, the small end of which connecting rod 52 (not shown) is advantageously connected to the driving means (not shown) of conveyor 6, and adapted to impart to the connecting rod 52 a reciprocating and substantially axial motion.

In the operation, each upwardly and downwardly directed movement of the connecting rod 52 from and towards its bottom dead center (see FIG. 2) is accompanied by a downwardly and upwardly directed movements of the fork shaped members 25 of arms 20 and 21.

Since each arm 20 and 21 constitutes, together with the related link member 27 and the related pliers shaped member 31, an articulated parallelogram, and since for one rotation of shafts 32 the movements of each pair of pliers 34 and 35 are equal and oppositely directed relative to the associated pliers 31, each upwardly and downwardly directed movement of connecting rod 52 from and toward said bottom dead center is accompanied by upwardly and, respectively, downwardly directed movements of the rocking levers 38 from and, respectively, toward the position shown in FIG. 2.

During said movements, the rocking levers 38 are kept substantially parallel to the related longitudinal side surfaces of stack 3 by the contact of the associated rollers 43 and 45 with said surfaces, due to the action of the springs 40.

The rollers 43 and 45 are supported by the related pins 42 and 44 by means of free wheel devices of conventional type, for example of the type known in the trade as INA HF O8I2, adapted to allow said rollers to idly rotate about the relative pin, and therefore to roll in contact with the outer edges of flaps 13 and 14 of blanks 1 during the upwardly directed movement of the rocking levers 38, and to lock the rollers during the downwardly directed movement of the rocking levers.

Figure 4:
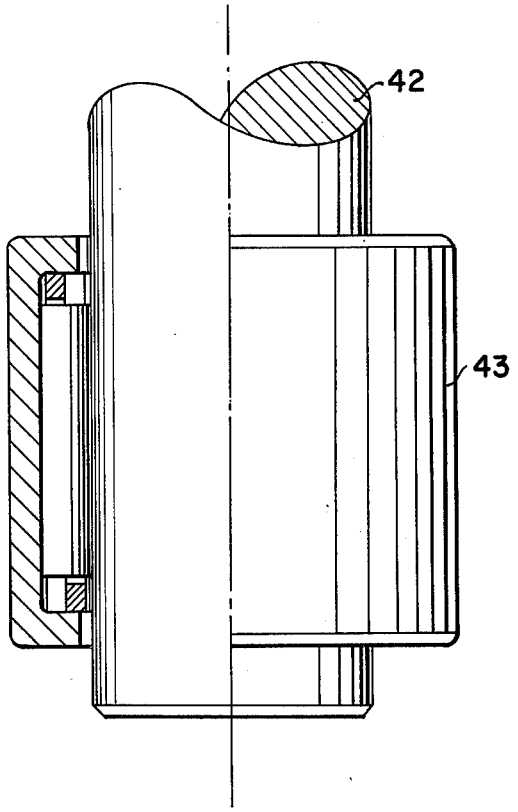
FIG. 4 is an enlarged side view, partly in section along line IV—IV of FIG. 5, of a conventional free wheel device arranged between one of the pins and bending rollers of side flap slope adjusting device of this invention.
Figure 5:
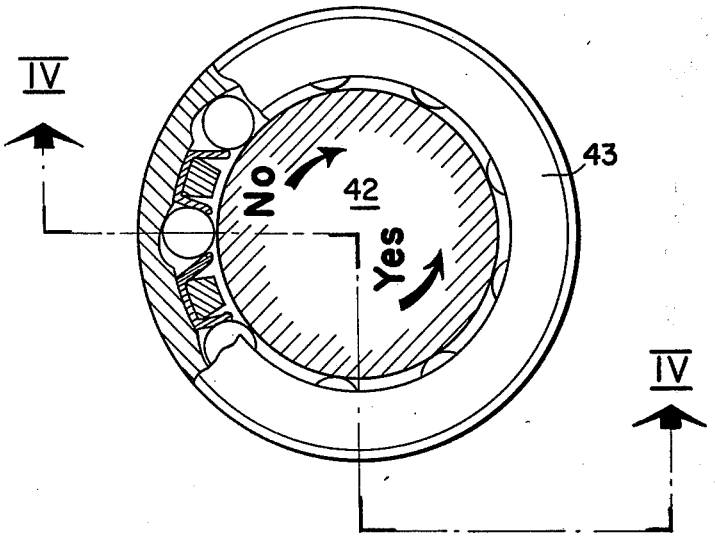
FIG. 5 is an end view, partly in transverse section, of FIG. 4.

FIGS. 4 and 5 illustrate the conventional INA HF 0812 free wheel device in connection with pin 42 and bending roller 43, the same device being arranged between pin 44 and bending roller 45 to allow the rollers to rotate freely in one direction, indicated by counterclockwise arrow marked "yes", during an upwardly directed movement of the rocking lever carrying the roller and for locking the roller in the opposite direction, indicated by clockwise arrow marked "no", during a downwardly directed movement of the rocking lever.

Thus, when the connecting rod 52 is downwardly moved, the external toothed surfaces of rollers 43 and 45 slide with sliding friction onto the outer side edges of flaps 13 and 14 bending the same in a direction opposite to their natural upwardly directed inclination, i.e. bending them downwardly.

It is of importance to note that the sliding contact of the toothed rollers 43 and 45 with the side edges of the flaps causes, other then the bending action of said flaps, also a very important secondary effect consisting in that to the blanks are imparted coplanar vibrations.

Said vibrations are favourable since they tend to flake off the stack 3 at least in proximity of the bottom portion of the magazine unit 2, which stack — otherwise — would form a substantially monolithic block owing to the blanks' weight, to the strong adhesion existing between the contacting surfaces of the blanks, and to the burrs present on the edges of the blanks due to the cutting operation of the blanks from a continuous web.

Should the vibrations to which the blanks 1 are subjected by rollers 43 and 45 not be sufficient to flake off the stack, to the bending device can easily be associated a flaking device of the type described in U.S. Pat. No. 3,947,017.

What we claim is:

1. A device for adjusting the slope of side flaps of stacked blanks, in particular of stacks of cardboard blanks to be individually fed in quick sequence to a packeting machine for packeting cigarettes into hinged-lid packets, each of the stacks of blanks being contained in a vertical magazine unit from the bottom of which the individual blanks are rhythmically withdrawn by suction means, which device comprises (a) at least one toothed bending roller facing a side surface of the stack of blanks in vertical alignment with the side flaps of the stack of blanks, (b) a rocking lever carrying the toothed bending roller, (c) a pin supporting the toothed bending roller, (d) a free wheel device arranged between the pin and the roller, the device allowing the roller to rotate freely during an upwardly directed movement of the rocking lever carrying the roller and for locking the roller during a downwardly directed movement of the rocking lever whereby the roller exerts a sliding friction on the outer side edges of the flaps only during the downwardly directed movement of the rocking lever to bend the flaps downwardly, and (e) driving means for imparting to the toothed bending roller a cyclic, vertically directed reciprocating motion in contact relationship with the flaps, and in one direction corresponding to the descending direction of the blanks along the vertical magazine unit towards the suction means, whereby the sliding friction is exerted during at least the last part of the motion in the one direction and along at least a bottom portion of the side surface of the stack of blanks.

2. The device of claim 1, further comprising spring means keeping the toothed bending roller in constant contact relationship with the outer side edges of the flaps.

* * * * *